US005467096A

United States Patent [19]

Takamoro et al.

[11] Patent Number: 5,467,096

[45] Date of Patent: Nov. 14, 1995

[54] ANTENNA FOR A RADIO COMMUNICATION APPARATUS

[75] Inventors: Kenji Takamoro, Tokyo; Koji Umeda, Saitama; Takao Ono, Tokyo, all of Japan

[73] Assignee: NEC Corporation, Tokyo, Japan

[21] Appl. No.: 201,340

[22] Filed: Feb. 24, 1994

[30] Foreign Application Priority Data

Feb. 25, 1993 [JP] Japan ..... 5-035929

[51] Int. Cl.[6] ..... H01Q 1/24; H01Q 1/36

[52] U.S. Cl. ..... 343/702; 343/895; 343/901

[58] Field of Search ..... 343/702, 895, 343/900, 901, 729, 725, 749, 752; H01Q 1/24, 1/36

[56] References Cited

U.S. PATENT DOCUMENTS

| | | | |
|---|---|---|---|
| 4,121,218 | 10/1978 | Irwin et al. | 343/702 |
| 4,868,576 | 9/1989 | Johnson, Jr. | 343/702 |
| 5,177,492 | 1/1993 | Tomura et al. | 343/702 |
| 5,204,687 | 4/1993 | Elliott et al. | 343/702 |
| 5,262,792 | 11/1993 | Egashira et al. | 343/702 |
| 5,317,325 | 5/1994 | Bottomley | 343/895 |

FOREIGN PATENT DOCUMENTS

| | | | |
|---|---|---|---|
| 0467822 | 1/1992 | European Pat. Off. . | |
| 516490A2 | 12/1992 | European Pat. Off. | H01Q 1/24 |
| 0522806 | 1/1993 | European Pat. Off. . | |
| 3-245603 | 11/1991 | Japan . | |
| 2148605 | 5/1985 | United Kingdom . | |
| WO92/16980 | 10/1992 | WIPO . | |

*Primary Examiner*—Donald T. Hajec
*Assistant Examiner*—Hoanganh Le
*Attorney, Agent, or Firm*—Young & Thompson

[57] ABSTRACT

A miniature and high performance antenna applicable to a radio communication apparatus and made up of a straight antenna rod and a loading coil. The tip of the straight antenna rod is received in the coil such that capacity coupling is set up between them. An antenna configuration is provided for setting up capacity coupling between the antenna rod and a feed portion.

6 Claims, 5 Drawing Sheets

ANTENNA FOR A RADIO COMMUNICATION APPARATUS

BACKGROUND OF THE INVENTION

1. Field of the Invention

The present invention relates to a miniature and high performance antenna applicable to a radio communication apparatus and made up of a straight antenna rod and a coiled element.

2. Description of the Related Art

Portable radio communication apparatuses, including hand-held telephones, are extensively used today. To enhance portability, the casing of this kind of apparatus is decreasing in size and weight. An antenna small enough to be retracted even into such a small casing has been proposed in various forms. The prerequisite with the apparatus is that it can respond to a call originated on a remote station even when the small antenna is retracted into the casing. Further, there is an increasing demand for higher antenna sensitivity. In light of this, it has been customary to provide the apparatus with a built-in antenna in addition to the retractable antenna and to use them selectively. However, the problem with this approach is that the apparatus has a complicated and bulky construction. To eliminate this problem, when the antenna is retracted into the casing, a loading coil portion associated with the antenna may be directly fed to insure sensitivity, as taught in, for example, Japanese Patent Laid-Open Publication (Kokai) Nos. 1-101702 and 1-101703. Antennas aiming at miniaturization are disclosed in, for example, Japanese Patent Laid-Open Publication No. 3-245603 and EP Publication No. 0 467 822.

However, conventional antennas are complicated in structure and, therefore, difficult to produce, resulting in an increase in production cost. Moreover, a part of metallic members included in the antenna is exposed to the outside, impairing the appearance of the apparatus. In addition, when a part of the human body touches or even approaches the exposed portion of the antenna, the frequency changes.

SUMMARY OF THE INVENTION

It is, therefore, an object of the present invention to provide an antenna for a radio communication apparatus which is simple in structure, easy to produce, and low in production cost.

It is another object of the present invention to provide an antenna for a radio communication apparatus which obviates exposed portions in order to enhance simple and attractive appearance.

It is another object of the present invention to provide an antenna for a radio communication apparatus which prevents the frequency from changing even when the human body approaches it.

It is another object of the present invention to provide an antenna for a radio communication apparatus which promotes the effective use of a limited space available in the apparatus.

An antenna for a radio communication apparatus of the present invention comprises a first whip antenna mounted on the casing of the apparatus and movable into and out of the casing, and a second whip antenna coaxially provided on the tip of the first whip antenna and accommodating a loading coil having a predetermined number of turns. The tip of the first whip antenna is received in the second whip antenna such that capacity coupling is set up between the first whip antenna and the second whip antenna. Further, the antenna has covering means for covering the first whip antenna and second whip antenna, coupling means for setting up capacity coupling between the first whip antenna and a feed section included in the apparatus, and grounding means for connecting a part of the first whip antenna to ground when the first whip antenna is retracted into the casing.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 6:
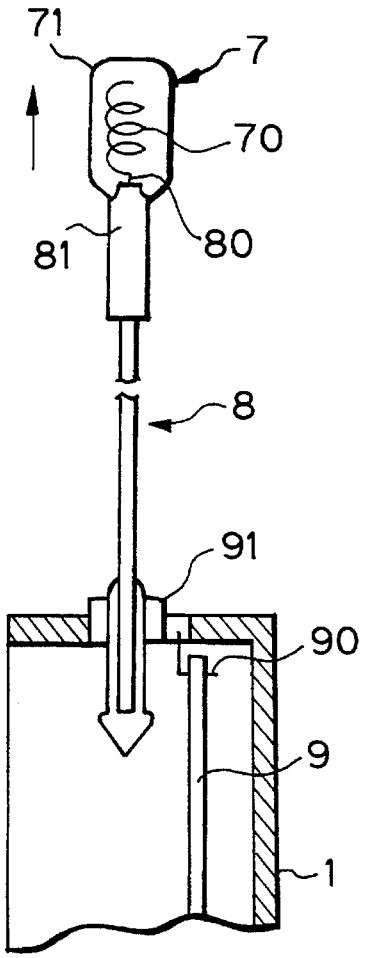
Fig. 6 PRIOR ART
FIG. 6 is a partly sectioned elevation showing a conventional antenna in an extended position.
Figure 7:
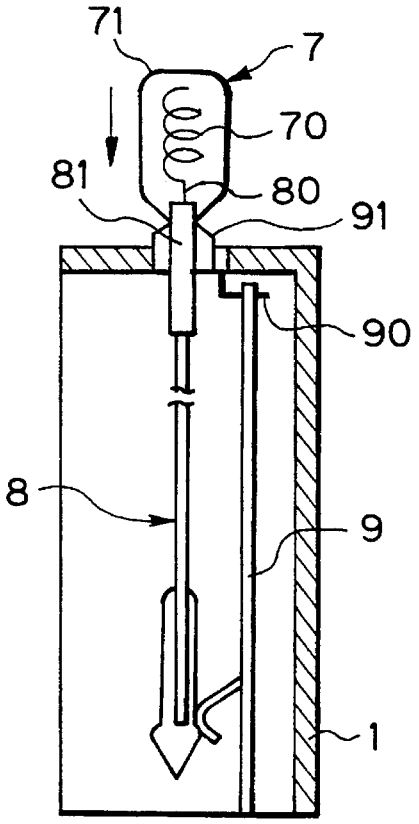
Fig. 7 PRIOR ART
FIG. 7 is a view similar to FIG. 6, showing the antenna a retracted position.

To better understand the present invention, a brief reference will be made to a conventional small size antenna disclosed in Japanese Patent Laid-Open Publication No. 3-245603, shown in FIGS. 6 and 7. As shown, the antenna is mounted on the casing I of a radio communication apparatus and made up of a straight antenna rod 8 and a short antenna section 7 provided on the tip of the rod 8. The antenna rod 8 has an electrical length which is substantially one-quarter of the resonance wavelength. The short antenna section 7 has an electrical length of substantially one-quarter of the resonance wavelength. A loading coil, or antenna coil, 70 is disposed in the antenna section 7 and has a predetermined number of turns. As shown in FIG. 6, when the antenna rod 8 is extended from the casing 1, the antenna rod 8 and loading coil 70 constitute a substantially half wavelength antenna in combination. As shown in FIG. 7, when the antenna rod 8 is retracted into the casing 1, only the short antenna section 7 with the coil 70 is positioned externally of the casing 1 and serves as a quarter wavelength antenna. There are also shown in the figures a circuit board 9, an element cover 71, a metallic movable connector 81, a feed portion 90, and a metallic fixed connector 91. When the antenna rod 8 is retracted into the casing 1, the movable connector 81 contacts the fixed connector 91 to feed the loading coil 70.

Figure 8:
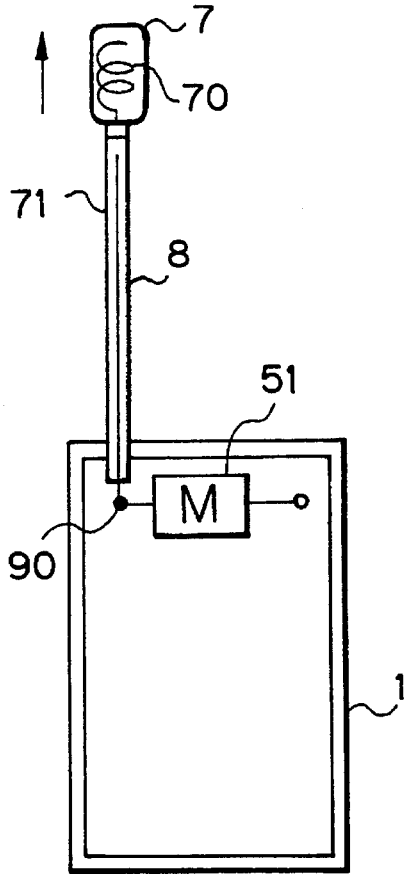
Fig. 8 PRIOR ART
FIG. 8 is a partly sectioned elevation showing another conventional antenna in an extended position.
Figure 9:
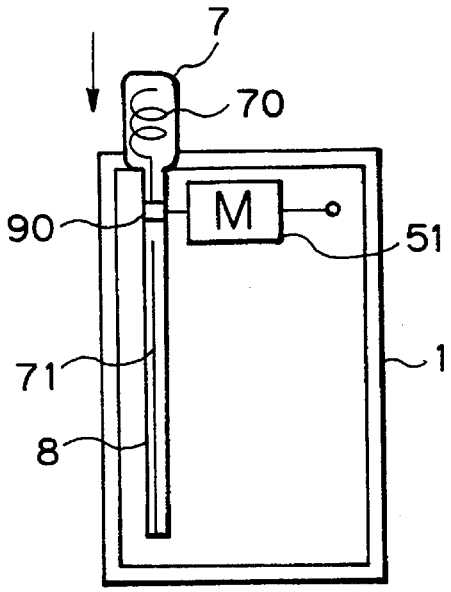
Fig. 9 PRIOR ART
FIG. 9 is a view similar to FIG. 8, showing the antenna in a retracted position.

FIGS. 8 and 9 show another conventional small size antenna. The same or similar constituent parts of this antenna as or to the constituents of the antenna described above are designated by the same reference numerals, and a detailed description thereof will not be made in order to avoid redundancy. As shown, the antenna rod 8 and the antenna coil, or coiled element, 70 each having a quarter wavelength are received in the element cover 71 and physically separate from each other. As shown in FIG. 8, when the antenna rod 8 is extended, the antenna is fed at the lower end of the antenna rod 8 with the result that substantially only the antenna rod 8 plays the role of an antenna. As shown in FIG. 9, when the antenna rod 8 is retracted into the casing 1, the antenna rod 8 is disconnected from the feed portion 90 while, at the same time, the lower end of the coil 70 is brought into connection with the feed portion 90. In this condition, only the coil 70 serves as a short antenna. In FIG. 9, the reference numeral 51 designates a matching circuit.

The antenna of FIGS. 6 and 7 and the antenna of FIGS. 8 and 9 (respectively referred to as a first and a second antenna hereinafter) have some unresolved problems left, as follows. The first antenna needs an extra machining step to have the tip of the antenna rod 8 and the coil 70 mechanically connected to each other at a junction 80. Further, a mechanical arrangement has to be provided between the antenna and the casing 1 which allows the lower end of the antenna rod 8 and the movable connector 81 to contact the fixed connector 91. A problem with the second antenna is that a complicated mechanical arrangement should be provided between the antenna and the casing 1 such that when the antenna rod 8 is extended, the lower end of the antenna rod 8 is fed while, when the antenna rod 8 is retracted, it is disconnected from the feed portion 90 and, at the same time, the lower end of the coil 70 contacts the teed portion 90. Therefore, the structure is complicated and expensive. Moreover, the first antenna has a drawback in that the movable connector 81 is exposed to the outside from the element cover 71 while the fixed connector 91 is exposed from the casing 1, impairing the appearance of the apparatus. When a human body touches or simply approaches the exposed part of the antenna, the frequency is caused to change. A change in frequency is a serious problem when it comes to a radio communication apparatus. Furthermore, the first antenna has a total length which is the sum of the lengths of the antenna rod 8 and coil 70, while the second antenna has a greater total length than the first antenna since the antenna rod 8 and coil 70 are physically separate from each other. Therefore, with any such antenna configurations, it is impossible to reduce the length and, therefore, to miniaturize the overall antenna.

Figure 1:
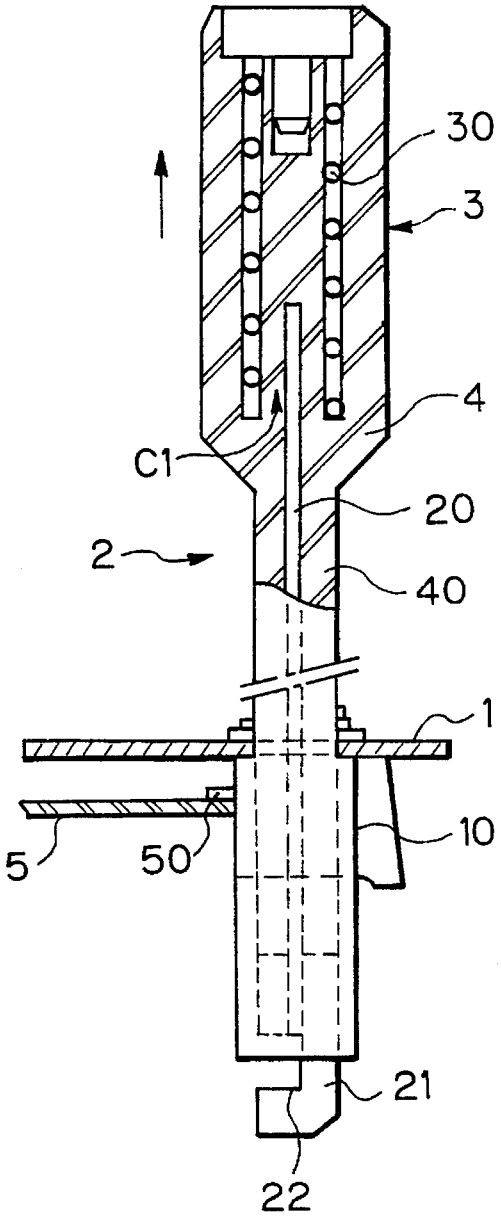
FIG. 1 is a partly sectioned elevation showing an antenna embodying the present invention in an extended position.
Figure 3:
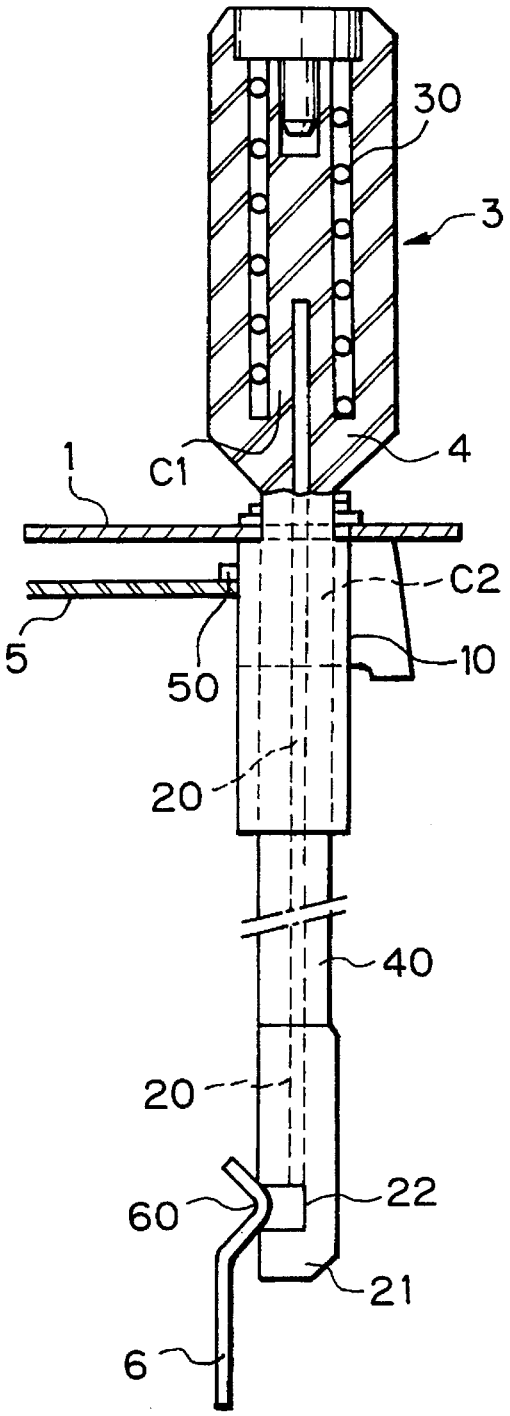
FIG. 3 is a view similar to FIG. 1, showing the antenna in a retracted position.
Figure 4:
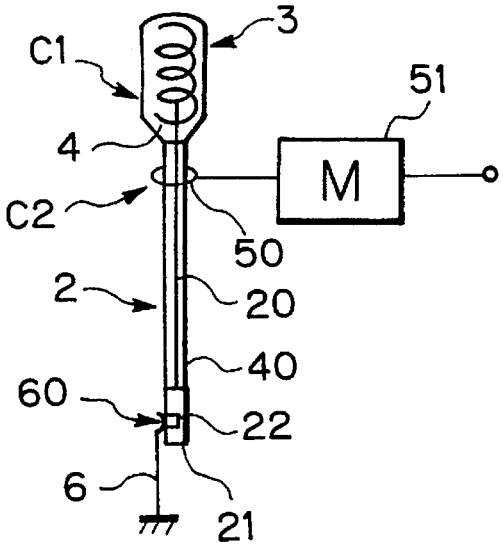
FIG. 4 is a schematic associated with FIG. 3.
Figure 5:
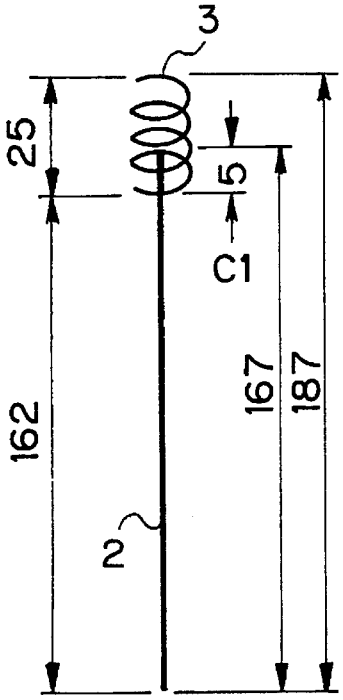
FIG. 5 is a schematic showing specific dimensions of various portions included in the embodiment, as measured in the retracted position.

Referring to FIGS. 1–5, an antenna embodying the present invention will be described. The illustrative embodiment pertains to an antenna for a portable hand-held telephone using a 900 MHz frequency band. As shown in FIG. 1, the antenna is made up of a first whip antenna section 2 and a second or short whip antenna section 3 coaxially provided on the tip of the antenna section 2. The whip antenna section 2 has a half wavelength (e.g. 167 mm as shown in FIG. 5). The short antenna section 3 has a quarter wavelength (e.g. 25 mm as shown in FIG. 5) and accommodates a loading coil or antenna coil 30 having a predetermined number of turns. The antenna section 2 has an element 20 whose upper end is received in the loading coil 30, such that capacity coupling C1 is set up between the two antenna sections 2 and 3. The coil 30 is enclosed within a coil case 4 while the element 20 is covered with an element cover 40. The coil 30 is made of phosphor bronze. The element 2 of the antenna section 2 made of a nickel-titanium (Ni-Ti) alloy which is a so-called super resilient metal.

Figure 2:
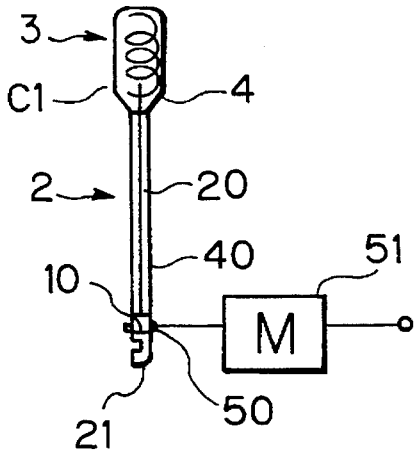
FIG. 2 is a schematic associated with FIG. 1.

The telephone has a casing 1 on which the elongate whip antenna section 2 is movably mounted through an opening formed in the casing 1. A ring 10 is affixed to the inner periphery of the casing 1 and surrounds the above-mentioned opening. A matching circuit 51, FIG. 2, is mounted on a printed circuit board 5. When the antenna section 2 is extended from element 20 of the antenna 2 is electrically connected to the matching circuit 51 via a feed portion 50 by direct feed. A metallic contact member 21 is fitted on the lower end of the antenna section 2 and formed with a notch 22 at one side thereof. A metallic ground member 6 extends from the bottom of the casing 1. As shown in FIG. 3, when the antenna section 2 is fully retracted into the casing 1, it is connected to the ground member 6 by the contact member 21 via a contact portion 60 formed at the upper end of the ground member 6.

In the illustrative embodiment, the upper end of the antenna section 2 is received in the short antenna section 3. In this condition, capacity coupling in high frequency is set up between the two antenna sections 2 and 3 at high frequency without regard to the extended/retracted position of the antenna section 2. When the antenna is extended, the sum of half wavelength and quarter wavelength of the two antenna sections, i.e., 3/4 is the overall electrical length of the antenna. The antenna, therefore, has substantially the same characteristic as a half wavelength antenna which is optimal for a portable hand-held radio communication apparatus.

As shown in FIG. 3, when the antenna section 2 is fully retracted into the casing 1, it is connected to the ground member 6 via the contact member 21 having the notch 22. At the same time, the upper end of the antenna section 2 is located at the ring 10. The other antenna section 3, setting up the capacity coupling C1 with the antenna section 2, implements the capacity coupling C2 with the feed portion 50. In this condition, only the antenna section 3 can interchange high frequency signals with the feed portion 50 without resorting to mechanical connection. In this way, in the retracted position, the antenna has an overall effective electrical length which is only the quarter wavelength particular to the short antenna section 3. In this case, as shown in FIG. 4, the impedance Z of the retracted antenna section 2 is made infinite so as to fully interrupt the feed to the antenna section 2, so that the antenna section 2 is, in effect, practically absent.

The coil 30 and the element 20 are respectively covered with the coil case 4 and the element cover 40, as stated earlier. In this condition, none of the element 20 and the capacity coupling portions C1 and C2 are positioned externally of the casing 1. This obviates the need for extra machining steps for mechanically connecting the upper end of the antenna section 2 and the short antenna section 3 and connecting the antenna section 2 to the casing 1. As a result, the antenna is simple in structure, easy to produce, and low in production cost. Further, the antenna provides the telephone with simple and attractive appearance due to the absence of exposed portions. Even when the human body approaches the antenna, the frequency is prevented from changing. In addition, the space available in the casing 1 can be effectively used due by virtue of the capacity coupling portion C1.

In the embodiment, the element 20 of the antenna section 2 is made of an Ni-Ti alloy belonging to a family of super resilient metals. The antenna section 2, therefore, has extremely high flexibility and will not bend or break even when handled without great care. Heretofore, implementing the antenna section 2 by a super resilient metal has made it extremely difficult to mechanically connect it to the coil 30. The embodiment eliminates this problem with the capacity coupling scheme.

If desired, the antenna section 2, i.e., element 20 may be provided with a telescopic rod antenna structure in order to further reduce the overall size of the antenna.

In summary, in an antenna of the present invention, the tip of a straight antenna rod is received in an antenna coil such that capacity coupling is set up between them. This, coupled with the fact that means is provided for setting up capacity coupling between the antenna rod and a feed portion when the antenna rod is fully received in a casing, allows the antenna rod and coil and the coil and feed portion to interchange electric signals with the feed portion without resorting to any mechanical connection. Since the antenna rod and coil are entirely concealed from the outside, a human body does not cause frequency to change even when approached the antenna. Further, grounding means is provided which connects a part of the antenna rod to a ground point when the rod is fully retracted into the casing. Hence, in the retracted position of the antenna, only the coil plays the role of an antenna; in the extended position, the whole antenna serves as an antenna with an electrical length which is the sum of the electrical lengths of the antenna rod and coil. The element of the antenna rod may be made of a super resilient metal to have high flexibility. In the conventional antennas discussed previously, a super elastic metal would make machining for connection extremely difficult and increase the cost since the antenna rod has to be mechanically connected to the coiled element as well as to other portions. In accordance with the present invention, the capacity coupling facilitates even such connection of the antenna rod. In addition, when the antenna rod is implemented as a telescopic structure, it can be folded and further miniaturizes the entire communication apparatus.

Various modifications will become possible for those skilled in the art after receiving the teachings of the present disclosure without departing from the scope thereof. For example, while the element 20 has been shown and described as protruding from the casing 1 and overlapping with the loading coil 30, the short whip antenna section 3 may be at least partly positioned in the casing 1. It is to be noted that means for setting up capacity coupling between a straight antenna rod and a feed portion also refers to means for setting up capacity coupling between an antenna coil and the feed portion when the antenna rod is retracted into a casing.

What is claimed is:

1. An antenna for a radio communication apparatus, comprising:

a first whip antenna mounted on a casing of said apparatus and movable into and out of said casing;

a second whip antenna coaxially provided on a tip of said first whip antenna and accommodating a loading coil having a predetermined number of turns, said tip of said first whip antenna being received in said second whip antenna without being connected to said second whip antenna with respect to D.C. such that capacity coupling is set up between said first whip antenna and said second whip antenna;

covering means for covering said first whip antenna and said second whip antenna;

coupling means for setting up capacity coupling between said first whip antenna and a feed section included in said apparatus when said first whip antenna is retracted into said casing; and grounding means for connecting a part of said first whip antenna to ground when said first whip antenna is retracted into said casing.

2. An antenna as claimed in claim 1, wherein said first whip antenna is made of a super resilient metal.

3. An antenna as claimed in claim 2, wherein said super resilient metal comprises a nickel-titanium alloy.

4. An antenna as claimed in claim 1, wherein said loading coil is made of phosphor bronze.

5. An antenna as claimed in claim 1, wherein said first whip antenna has a telescopic structure.

6. An antenna as claimed in claim 1, further comprising means for coupling said second whip antenna and said feed section in capacity when said first whip antenna is retracted into said casing.

* * * * *